US009364732B2

(12) United States Patent
Endreszl

(10) Patent No.: US 9,364,732 B2
(45) Date of Patent: Jun. 14, 2016

(54) TOSSING GAME

(71) Applicant: Mark Endreszl, Novi, MI (US)

(72) Inventor: Mark Endreszl, Novi, MI (US)

( * ) Notice: Subject to any disclaimer, the term of this patent is extended or adjusted under 35 U.S.C. 154(b) by 177 days.

(21) Appl. No.: 14/035,350

(22) Filed: Sep. 24, 2013

(65) Prior Publication Data

US 2015/0084283 A1 Mar. 26, 2015

(51) Int. Cl.

| | |
|---|---|
| ***A63B 63/00*** | (2006.01) |
| ***A63B 63/08*** | (2006.01) |
| ***A63B 67/06*** | (2006.01) |
| *A63B 71/04* | (2006.01) |
| *A63B 37/06* | (2006.01) |
| *A63B 71/06* | (2006.01) |

(52) U.S. Cl.

CPC ..... *A63B 63/00* (2013.01); *A63B 63/08* (2013.01); *A63B 67/06* (2013.01); *A63B 37/06* (2013.01); *A63B 63/003* (2013.01); *A63B 71/04* (2013.01); *A63B 2071/0694* (2013.01)

(58) Field of Classification Search

CPC ..... A63B 67/06; A63B 63/00; A63B 63/08; A63F 9/0204

USPC ..... 273/398–402

See application file for complete search history.

(56) References Cited

U.S. PATENT DOCUMENTS

| | | | | | |
|---|---|---|---|---|---|
| 593,343 | A * | 11/1897 | Whitney | 273/400 |
| 731,850 | A * | 6/1903 | Bradbury | 273/355 |
| 1,442,054 | A * | 1/1923 | Dixon | 273/397 |
| 1,542,063 | A * | 6/1925 | Knight | 273/399 |
| 1,996,986 | A * | 4/1935 | Weinberg | 273/400 |
| 3,351,344 | A * | 11/1967 | Dupuy | 273/400 |
| 4,877,256 | A * | 10/1989 | Falloon | 273/400 |
| 5,290,040 | A * | 3/1994 | Boroski | 273/348.4 |
| 5,516,114 | A * | 5/1996 | Michlin et al. | 273/400 |
| 5,704,612 | A * | 1/1998 | Kelly et al. | 273/402 |
| 8,205,887 | B2 * | 6/2012 | Wyland | A63B 67/066 273/317 |
| 8,651,492 | B1 * | 2/2014 | Cappuccio | 273/348 |
| 2007/0063447 | A1 * | 3/2007 | Gholson et al. | 273/400 |
| 2010/0044964 | A1 * | 2/2010 | Constantine et al. | 273/378 |
| 2010/0194047 | A1 * | 8/2010 | Sauerwine | 273/400 |
| 2012/0169012 | A1 * | 7/2012 | Parker | A63B 67/002 273/400 |
| 2014/0265136 | A1 * | 9/2014 | Parker et al. | 273/398 |
| 2015/0069708 | A1 * | 3/2015 | Mashburn | 273/400 |

* cited by examiner

*Primary Examiner* — Mark Graham

(74) *Attorney, Agent, or Firm* — Troutman Sanders LLP

(57) ABSTRACT

A tossing game is disclosed. The game can comprise two stations, and each station can comprise a plurality of targets. The targets can comprise an opening, and players can attempt to toss tossing articles into the openings of the targets. Scoring for the game can be implemented in a number of ways. In one method, for example, points can be awarded for each target based on whether a first player or second player was the most recent player to toss a tossing article into that target. The number of points awarded can be a function of a given point value assigned to that target. The game can be played in a variety of ways, and can provide seemingly endless hours of fun and entertainment.

12 Claims, 4 Drawing Sheets

TOSSING GAME

BACKGROUND

1. Field of the Invention

Various embodiments of the present invention relate to games, and more particularly, to tossing games.

2. Background of Related Art

When enjoying time outside in nice weather, there are a lack of games or activities to be played. The games that are available, unfortunately, often have limited excitability and aren't multi-dimensional.

One relatively popular game is "Cornhole." Cornhole involves members of opposing teams tossing beanbags at boards that each have one hole. Points are awarded to the teams at the end of various rounds based on the number of beanbags on the board and in the hole. Unfortunately, Cornhole has limited excitement and a low level of difficulty, which can make the game less exciting than some would like.

Another existing game is Pipeball. In this game, members of opposing teams toss tennis balls into a set of pipes, and points are awarded based on which pipes the balls land inside of. Like Cornhole, however, this game has limited excitement. Moreover, this game has not grown to be exceedingly popular and has drawbacks, as the tennis balls often bounce awkwardly away from the set of pipes during play.

What is needed, therefore, is a game that provides hours of entertainment and enjoyment for players of almost any age. To enhance excitement, the game should combine popular bag tossing, plastic pipes of various heights and diameters, and scoring relative to the level of difficulty of tossing a bag in a given pipe. The game should be fun, entertaining, and difficult. It is to such a game that embodiments of the present invention are primarily directed.

SUMMARY

Briefly described, embodiments of the present invention can comprise a tossing game. The game can provide a new dimension to indoor and outdoor tossing-style games. In some embodiments, the game can take the familiar approach of tossing an object into, onto, or toward something, but there are several improvements that make the game more desirable than those commercially available. For example, in some embodiments, the object that is being thrown (the "tossing article") is shaped differently, and the object that it is being thrown toward (the "station") has a design unlike known designs. In some embodiments, the game can be called "Bag-Pipes."

Each station of the game can comprise multiple pipes, or targets. The targets can be arranged in a plurality of rows, and each row can have a given height of the targets and diameter of an opening of the targets. Each pipe in a row can also have the same assigned point value. These specifications, however, can vary from target to target or row to row.

The scoring for the game can also be unique. In some embodiments, for example, a "trump rule" can be employed. The trump rule can dictate that only the player or team that last tosses a bag into a pipe, or target, scores points for that target. This rule can add a new dimension to known tossing games.

Embodiments of the present inventions can comprise a method of playing a game. The method can comprise providing at least one station having a plurality of targets and each target can have a point value associated with it. The method can further comprise providing a plurality of tossing articles. The method can further comprise instructing a first player to toss a tossing article of the plurality of tossing articles into an opening of a target of the plurality of targets. The method can further comprise instructing a second player to toss a tossing article of the plurality of tossing articles into an opening of a target of the plurality of targets. The method can further comprise awarding an award point value to the first player or the second player based on whether the first player or the second player is the most recent player to toss a tossing article into a given target of the plurality of targets, and the award point value can be a function of the point value associated with the given target.

In some embodiments, the method can further comprise, at the conclusion of a round of the game, awarding an award point value to the first player or the second player for each respective target of the plurality of targets that the first player or the second player has tossed a tossing article into. In some embodiments, the method can further comprise, at the conclusion of a round of the game, awarding a round point value to the first player or the second player, and the round point value can be calculated from the first player's and second player's award point values. In some embodiments, the round point value can be a net of the first player's and second player's award point values.

In some embodiments, the method can further comprise declaring that the first of the first player and the second player to be awarded a predetermined sum of round point values wins the game. In some embodiments, the method can further comprise declaring that the first player wins the game when the first player tosses a tossing article into an opening of a selected target. In some embodiments, the first player can be a member of a first team and the second player can be a member of a second team, the first team and the second team each having a plurality of members.

Embodiments of the present invention can further comprise a station for use with a tossing game. The station can comprise a plurality of targets arranged in a plurality of rows, each target having a point value associated with the target. The point value can be based on the row in which the target is arranged, and each target can comprise a front, a back, and a top rim having a top profile. In some embodiments, the top rim can define an opening of the target and the top profile can be angled approximately 20 degrees downward from the back to the front. IN some embodiments, one target of the plurality of targets can be taller than each of the other targets and can be located behind each of the other targets.

In some embodiments, the diameter of the targets in a first row of targets can be smaller than the diameter of the targets in a second row of targets, the first row being located forward of the second row. In some embodiments, the diameter of the targets in the second row of targets can be smaller than the diameter of the targets in a third row of targets, the second row being located forward of the third row. In some embodiments, at least one of the rows of targets can be curved. In some embodiments, each target can be formed from a pipe and the targets can be fastened together with mechanical fasteners.

Embodiments of the present invention can further comprise a tossing game comprising a first station and a second station that can each have a plurality of targets, each of the targets can comprise a top rim defining an opening of the target. The game can further comprise a plurality of tossing articles for tossing into the openings of the targets. In some embodiments, a first player and a second player attempt to toss the tossing articles into the openings of the targets. In some embodiments, at the conclusion of a round of the game, an award point value can be awarded to the first player or the second player for each target of the plurality of targets that the first player or the second player has tossed a tossing article into. In some embodiments, the award point value for each respective target can be based on whether the first player or the second player is the most recent player to toss a tossing article into the target.

In some embodiments, the game can further comprise a walkoff target of the plurality of targets, wherein the first player wins the game when the first player tosses a tossing article into the opening of the walkoff target. In some embodiments, the walkoff target is taller than each of the other targets and is located behind each of the other targets.

In some embodiments, each of the targets comprises a front and a back and the top rim of each target has a top profile, and the top profile can be angled approximately 20 degrees downward from the back to the front. In some embodiments, the targets can be arranged in rows, and each target can have a point value associated with the target, and the point value can be based on the row in which the target is arranged. In some embodiments, the award point value for each respective target can be a function of the point value associated with the target.

In some embodiments, the opening of each target in a first row of the first station can have a first diameter the opening of each target in a second row of the first station can have a second diameter. In some embodiments, the first diameter can be smaller than the second diameter.

In some embodiments, at least a first target of the plurality of targets can comprise a first color representing a first point value and a second target of the plurality of targets can comprise a second color representing a second point value that is different than the first point value. In some embodiments, at least one tossing article of the plurality of tossing articles can include a cover portion comprising at least one of: duck cloth, canvas, nylon, burlap, wool, cotton, and polyester.

These and other objects, features, and advantages of the present invention will become more apparent upon reading the following specification in conjunction with the accompanying drawing figures.

DETAILED DESCRIPTION

Figure 1:
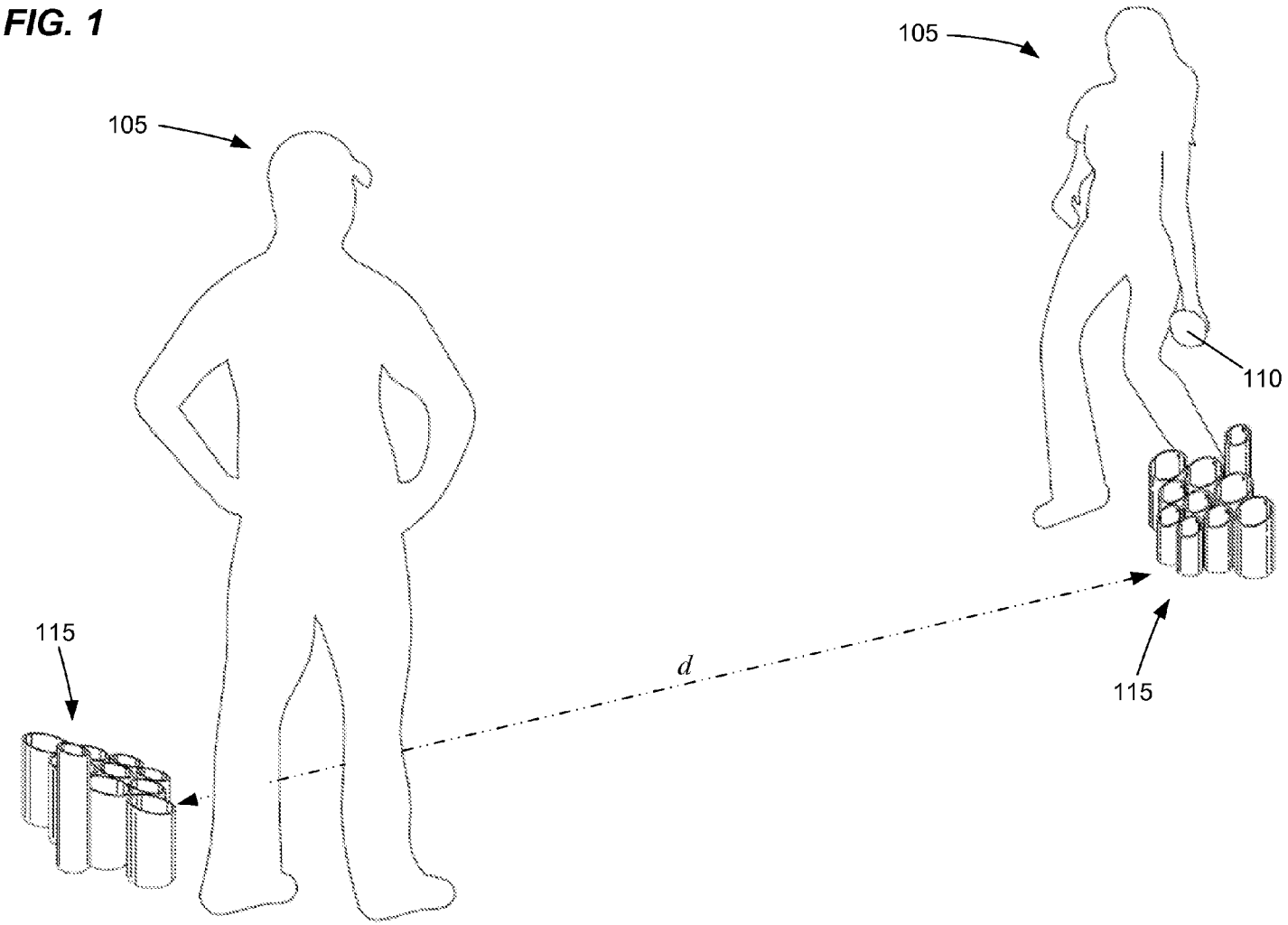
FIG. 1 depicts two players playing a tossing game, in accordance with some embodiments of the present invention.

To facilitate an understanding of the principles and features of the various embodiments of the invention, various illustrative embodiments are explained below. Although exemplary embodiments of the invention are explained in detail as being systems and methods related to a tossing game, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

To facilitate an understanding of the principles and features of the present invention, various illustrative embodiments are explained below. In particular, various embodiments of the present invention are described as a tossing game, methods of playing a tossing game, or components of a tossing game. Some aspects of the invention, however, may be applicable to other contexts, and embodiments employing these aspects are contemplated. For example and not limitation, some aspects of the invention may be applicable to various types of games. Accordingly, where terms such as "tossing" are used throughout this disclosure, it will be understood that other types of games, devices, entities, objects, or activities can take the place of these in various embodiments of the invention.

The Game

As described above, a problem with existing games, especially games meant to be played outdoors, is that they offer limited excitement and limited difficulty. Embodiments of the present invention, however, provide a game, methods of playing a game, and components of a game that solve these problems. In some embodiments, the game is called "BagPipes."

As shown in FIG. 1, embodiments of the present invention can provide a game. The game can be played with one or more players 105, one or more tossing articles 110, and one or more stations 115.

The tossing articles 110 can be bags, and in some embodiments, the tossing articles 110 can be beanbags filled with corn or beans. In some embodiments, moreover, the tossing articles 110 can be bags with a cover portion 120. Moreover, the cover portion 120 can be made from duck cloth, duck canvas, canvas, nylon, burlap, wool, cotton, polyester, leather, and combinations of each (such as a cotton/polyester blend) or the like. The cover portion 120 can be filled with pellets, such as rubber pellets, plastic pellets, ceramic pellets, glass pellets, PVC pellets, expanded polystyrene pellets, expanded polypropylene pellets, metal pellets, or the like The cover portion 120 can also be filled with corn, beans, pea stone, and the like. Moreover, unlike in Cornhole or other conventional games, the tossing articles 110 can be circular shaped or pancake-shaped. This is useful because, as explained below, the bags are sometimes being tossed into a cylindrical opening. When playing Cornhole, the bags are square and do not fit into a player's hand comfortably, and the player is also throwing a square bag into a circular hole. When playing Pipeball, players throw tennis balls, which bounce very awkwardly and can end up rolling away from the intended target, especially if playing on a hill or other non-flat surface. The circular tossing articles 110 therefore provide advantages over known systems as they better fit into a circular opening and do not bounce awkwardly or roll away.

Figure 2:
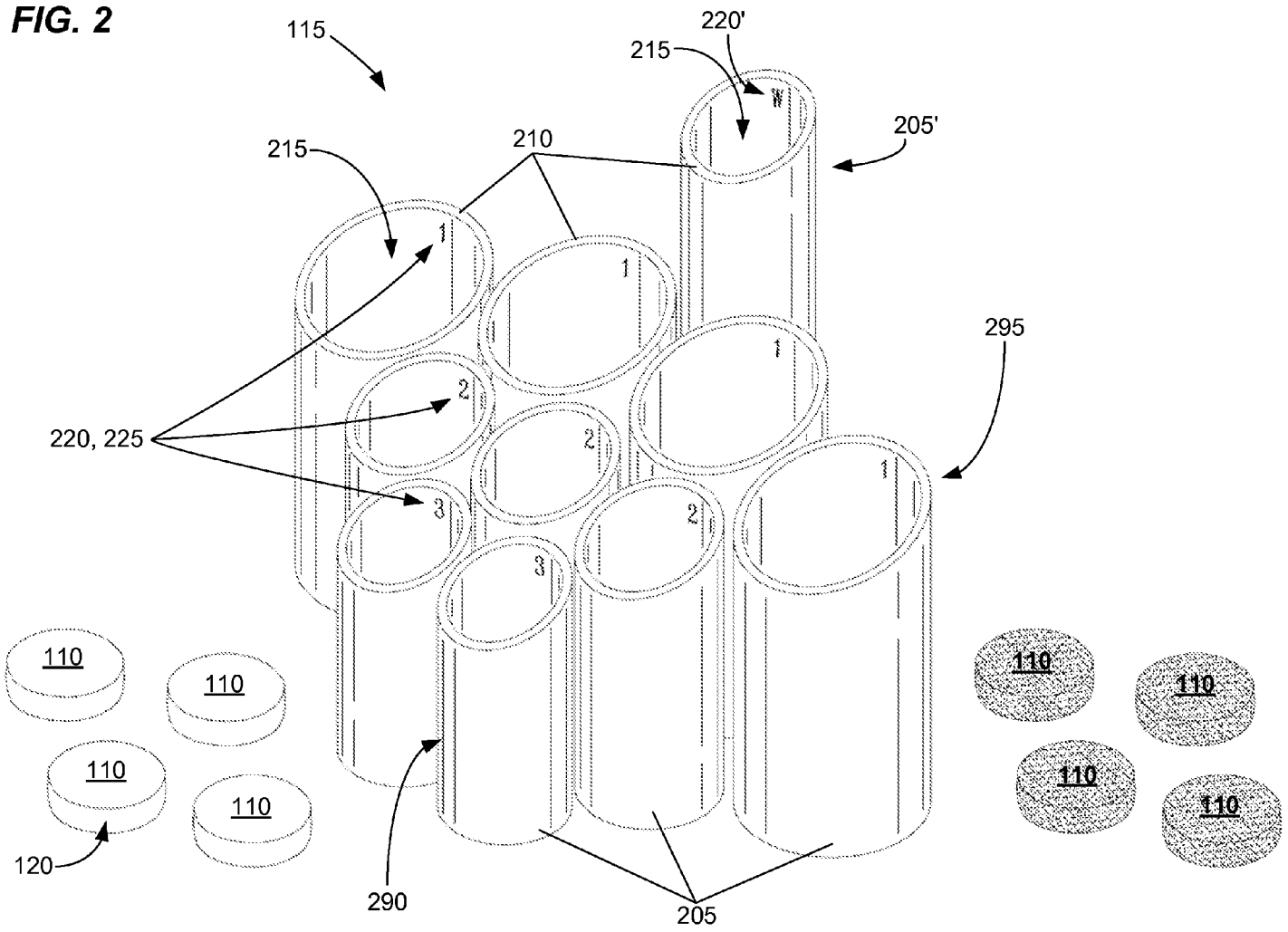
FIG. 2 depicts a perspective view of a station and tossing articles for a tossing game, in accordance with some embodiments of the present invention.

As shown in FIG. 2, in some embodiments, different colored tossing articles 110 can be used. Thus, where multiple teams of one or more players 105 are playing the game, each team can use tossing articles 110 of a color different from the other team's tossing articles 110. This can help the players 105 or scorekeepers keep track of each team's progress and scoring. In some embodiments, each team's tossing articles 110 can comprise a design, such as a sports team logo, color pattern, or custom BagPipes team logo, and the design can be different for each team.

In some embodiments, when playing the game, the front of the stations 115 are placed a distance d apart, as shown in FIG. 1. In some embodiments, d can be approximately 25 feet or approximately 20 feet, but can range from approximately 5 feet to approximately 50 feet.

As shown in FIG. 2, each station 115 can comprise a plurality of targets 205. As shown in FIG. 2, each station 115 can comprise ten targets 205, but, in some embodiments, each station can comprise from 2 to 20 targets 205. The targets 205 can also be arranged in a variety of arrangements, as described below.

Figure 3:
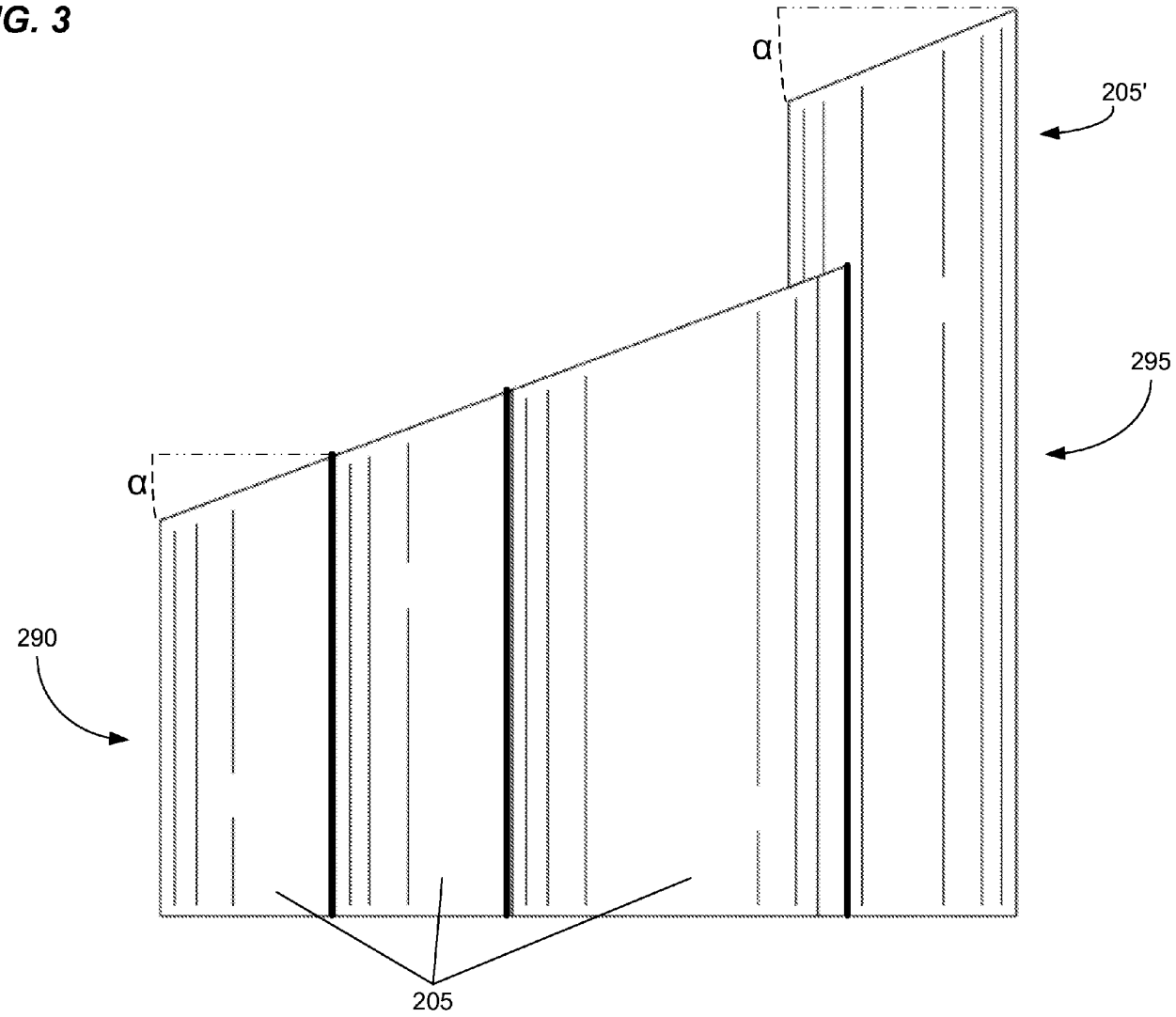
FIG. 3 depicts a side view of a station for a tossing game, in accordance with some embodiments of the present invention.

In some embodiments, the targets 205 can have a front 290, a back 295, and a top rim 210. The top rim 210 can define an opening 215 of the targets 205. In some embodiments, it can be an object of the game to toss the tossing articles 110 into the openings 215. The top rim 210 can also define a top profile of each target 205. The top profile can describe the shape, configuration, and/or orientation of the top rim 210 and/or the top of each target 205 generally. In some embodiments, the top profile can be sloped or angled downward from horizontal from back to front, as shown in FIGS. 2 and 3. In some embodiments, the angle of the downward slope from horizontal can be denoted by a, as shown in FIG. 3. In some embodiments, a can be approximately 20 degrees. In various embodiments, a can vary from approximately 0 degrees to approximately 50 degrees, approximately 15 degrees to approximately 30 degrees, and/or approximately 18 degrees to approximately 22 degrees.

Through experimentation, the inventors of the present invention have found that an approximately 20 degree angle $\alpha$ is an improvement over the 10 typical degree angle of Cornhole and the 30 typical degree angle of Pipeball. For example, in Cornhole, one hole at a 10 degree angle provides a set level of difficulty that does not contribute much excitement. In Pipeball, the 30 degree angle provides a very inconsistent bounce factor. 20 degrees, however, has been found to make the game difficult while adding a desirable amount of bounce back from the targets.

In some embodiments, as can be seen in FIG. 2, the targets 205 of each station 115 can be arranged in a plurality of rows. Each row can have one or more targets 205. Moreover, as can also be seen in FIG. 2, each target 205 can have a point value 220 associated with the target 205. In some embodiments, the point value can be indicated by a numerical point value indicator 225. In some embodiments, as shown in FIG. 2, the point value 220 can be based on the row in which the target 205 is arranged. Thus, in some embodiments, all of the targets 205 in a given row can have the same point value. In some embodiments, however, the point values 220 can be assigned based on column, instead of row, or other factors.

In some embodiments, one designated target 205' can be taller than the other targets. This designated target 205' can also be located behind the other targets 205, as shown in FIGS. 2 and 3. In some embodiments, this designated target 205' can have a point value 220' associated with it that is higher than the point values 220 of the other targets 205. In some embodiments, however, this designated target 205' can have a point value 220' associated with it that causes a player 105 who tosses a tossing article 110 into the opening 215 of the designated target 205' to win the game immediately, as explained below.

In some embodiments, as shown in FIG. 2, the rows of targets 205 can be curved, not straight. More specifically, the rows can be curved inward toward the front of the station 115, as shown in FIG. 2. This curvature can resemble a semicircle or similar curved shape. Moreover, in some embodiments, different targets 205 can be colored differently. In some embodiments, for example, the targets 205 can be colored to represent their point value 220 so that all targets 205 having a first point value 220 are one color and all targets 205 having a second point value 220 are a different color.

Each row of targets 205 can also comprise targets 205 with the same height. Moreover, the height of targets 205 of one row can be different from the height of targets 205 in other rows. Thus, as shown in FIG. 2, the first, or forward most row of targets 205 can have the smallest height, the second row can have a slightly bigger height, and the next row can have an even bigger height, and so on. Similarly, each row of targets 205 can comprise targets 205 with the same diameter. Moreover, the diameter of targets 205 of one row can be different from the diameter of targets 205 of other rows (or alternatively, they diameters of all the targets 205 can be the same). Thus, as shown in FIG. 2, the first, or forward most row of targets 205 can have the smallest diameter, the second row can have a slightly larger diameter, and the next row can have an even larger diameter, and so on. In addition, as shown in FIG. 2, the number of targets 205 in each row can vary. Thus, the front row can have two targets 205 (or only one if desired), the second row can have more than the front row, and subsequent rows can have more than the second row. In some embodiments, the front row can have two targets 205, the second row can have three targets 205, the third row can have four targets 205, and the fourth row can have only the designated target 205'. Thus, as shown in FIG. 2, in some embodiments the stations 115 can be substantially triangular shaped.

Accordingly, in some embodiments, it can be most difficult to toss a tossing article into the designated target 220', and doing so can cause a player 105 to win the game for his or her team. The next most difficult targets 205 can be those in the front row, and the targets 205 can become easier to toss into as the rows progress backward until the designated target 220' is reached. Thus, the rows toward the back of the station 115

(except for the designated target 220') can be assigned a lower point value than the rows toward the front of the station 115. As can be seen, therefore, instead of throwing into one hole, as a person does in Cornhole, there can be a series of several targets 205 that players 105 can attempt to toss a tossing article 110 into, and each target 205 can have its own level of difficulty due to varying heights, diameters, and locations, and the point value for that target 205 can be assigned accordingly. This can increase the difficulty of the game and make the game exceedingly entertaining.

To play the game, in some embodiments, two or more players can be divided into teams. The tossing articles 110 can then be tossed, one-by-one, to achieve the most points. The tosses can be underhand or overhand, or a basketball-type wrist flick or jumpshot. The teams will usually toss in an alternating fashion, such that a member of the first team tosses first, and then a member of the second team tosses, and then the member of the first team tosses again, and so on, until all of the tossing articles 110 have been tossed. Alternately, the first team can toss all of their tossing articles 110 first the second team can then toss their tossing articles 110. This can be the completion of the first round. At this point, the players can retrieve the tossing articles 110 and toss at the other station 115 for a second round. Or, if there are multiple players 105 on a team, some of the other players 105 can toss at the other station 115 for the second round. In some embodiments, the game is played with eight tossing articles 110, which means that each team will toss four tossing articles per round 110. The process can be repeated for the necessary number of rounds, until one team is declared the winner.

Scoring for the game can be implemented in a number of ways. In some embodiments, as shown in FIG. 2, the third row of targets 205 can be worth one point each, the second row of targets 205 can be worth two points each, and the front row of targets 205 can be worth three points each. The designated target 205' can be worth a higher number of points than the first through third rows or can be a "walkoff," meaning that a player 105 wins the game for his or her team immediately if he or she tosses a tossing article 110 into the designated target 205'. As described above, each team can alternate shots until all four tossing articles 110 for each team are tossed. In some embodiments, the tossing article 110 must completely go into the opening 215 of the target 205 to count for scoring. In some embodiments, the tossing article 110 can be bounced from the ground into a target 205, and in some embodiments bouncing is prohibited and a bounced tossing article 110 will not count for scoring.

In some embodiments, scoring is based on a "trump rule," meaning that the top tossing article 110 in each target 205, or the tossing article 110 most recently tossed into each target 205, determines which team is awarded points for each target. For example, if the first team tosses a bag into a two-point target 205 and then the second team tosses one in the same target 205, the second team's bag "trumps" the first team's bag and thus the second team's bag is the only one that counts for scoring. If the round ended here, the second team would be awarded an award point value of two points for this target and the first team would get zero points. If the round continued, and the first team then tossed another bag on top of the second team's bag, all of the first team's bags in that target 205 would count for scoring. Thus, the first team would get an award point value of four points (two points for each bag in the target), and the second team would get zero points. Accordingly, the award point value for each target 205 can be a function of the point value of the target 205 and the number of bags of the scoring team in the target 205. More specifically, the award point value can be the point value 220 of the target 205 times the number of bags of the scoring team in the target 205.

At the end of each round, a round point value can be awarded to one of the teams. To determine the round point value, the award point values for each target can be tallied. The round point value is then the difference between the sums of the award point values for each team. For example, if the first team was awarded seven award points and the second team was awarded four award points in a round, the first team would be awarded three round points. The next round would then begin. The first team to score predetermined amount of round points, or get a "walkoff," is declared the winner. In some embodiments, the first team to score twenty-one round points, or get a "walkoff," is declared the winner. In some embodiments, the opposing team can have the opportunity to throw any remaining tossing articles 110 for the opportunity to "trump" the "walkoff."

In some embodiments, instead of employing the "trump rule," every bag that is tossed into a target 205 can count for scoring. Thus, if the first team tosses a bag into a two-point target 205 and then the second team tosses one in the same target 205, each team would be awarded an award point value of two points for this target. If the round continued, and the first team then tossed another bag on top of the second team's bag, the first team would be awarded four award points and the second team would be awarded two award points. Thus, the first team would get an award point value of four points (two points for each bag in the target), and the second team would get zero award points.

Figure 4:
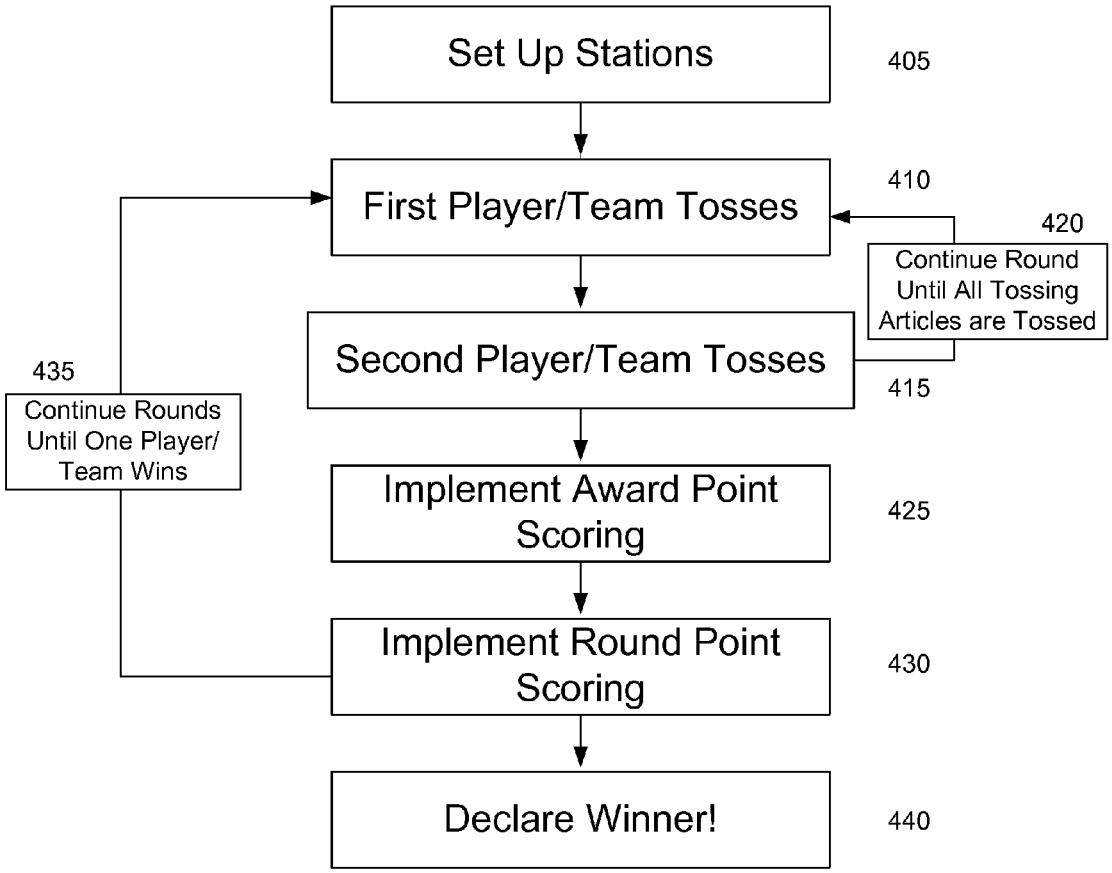
FIG. 4 depicts a method of playing a tossing game in accordance with one example of the present invention.

A method of playing the game is illustrated in FIG. 4. As shown, the stations 115 can be set up 405, and the first player 105 (who may be a member of a first team of one or more players 105) can then toss a tossing article 110 toward a station 115, 410. The second player 105 (who may be a member of a second team of one or more players 105) can then toss a tossing article 110 toward a station 115, 415. This process can be repeated until the first player 105 and the second player 105 have each tossed all of their respective tossing articles 110, 420. The scoring for the first round can then be calculated. More specifically, the award point scoring can be implemented 425 to determine the award points for each team for each target, and the round point scoring can be implemented 430 to determine the round points for each team. It can then be determined if one of the players/teams has won the game, or if another round will take place 435. If a player/team has won, that player/team can be declared the winner 440. Of course, in some embodiments, if one of the players 105 tosses a tossing article into the designated target 205' that player is awarded a "walkoff" and that player 105 (and/or his team) can immediately be declared the winner In some embodiments, however, the opposing team could have the opportunity to throw the remaining tossing articles for the opportunity to "trump" the "walkoff."

Assembly

Embodiments of the present invention comprise a method for assembling the stations 115. In some embodiments, there are two stations 115, or playing setups, and each are identical. The following describes assembly of one exemplary station 115 that employs PVC pipe as the target 205 material. Other methods, and stations 115 of different dimensions, materials, and assembly techniques, are envisioned by and set forth in this description.

To make each station 115, one may use:

Quantity (8) of 6" diameter PVC pipe cut at 12.5" heights.
Quantity (6) of 5" diameter PVC pipe cut at 10.5" heights.
Quantity (4) of 4" diameter PVC pipe cut at 8.75" heights.

Quantity (2) of 4" diameter PVC pipe cut at 19" heights.

Quantity (144) of a 2-piece plastic ratcheting rivet (for example, ITW Fastex part #236-170406-03-1010).

Quantity (2) of 1" Peel & Stick Vinyl Letters & Numbers

Quantity (2) of 4" Rubber Quick Cap

Quantity (4) of one color 5⅜" diameter corn-filled bags, and another quantity (4) of a different color. These bags have a double stitch mark creating a ⅜" overlap and the inside 5" holds 8 ounces of corn kernels.

Spray paint of desired color

Begin with four of the 6" diameter pipes in a line on the back row. Then place three of the 5" pipes in front of them in the indention of the 6" pipes as if you were aligning them like bowling pins or a triangle. Then place two of the 4" pipes the same way in front of the 5" pipes. Then take the longer 19" length of the 4" diameter pipe and place it in the back middle of the 6" pipes.

The pipes should be assembled together in a tight fit. With a pencil, mark the points where each pipe touches another pipe. Then make a vertical line down the length of each pipe. This line should represent the point where each pipe touches another pipe down the full height or length of the pipe. Then take a 17⁄64' drill bit and drill a hole 3" up from the bottom on the line, and repeat for every vertical line on every pipe. This will be the first of two points of fixation. The second point of fixation will be different as the heights of each pipe changes. On all 6" pipes, drill the second hole at a height of 8" up from the bottom on the line, and also 8" up from the bottom on the 5" pipes only on the edges that touch the 6" pipes. On the edges that touch the 4" pipes, drill a hole that is 6" up from the bottom on the line. This can also be done on the 4" pipes that are up front as well. However, for the 4" pipe that is in the far back for the designated target 205', drill a hole that is 9" up from the bottom on the line. The same height is required on the back of the two 6" pipes that touch the taller 4" pipe.

After all 72 holes are drilled, if desired, prior to final assembly, paint the pipes to the desired color using two coats of spray paint. Then, attach the Rubber Quick Cap on the bottom of the 4" pipe. This serves as a catch for storing the 8 circular bags. Then, take the 2-piece plastic ratcheting rivets and insert and ratchet together in each hole. Each side of the plastic ratcheting rivet are identical.

Attach the peel and stick numbers with the 6" diameter pipes each getting a number "1", the 5" pipes each getting a number "2", the smaller 4" pipes each getting a number "3", and the taller 4" pipe getting the letter "W".

Repeat this process for the other station 115.

While the invention is described above as employing PVC pipes as the targets, other materials can be used. For example, the station 115 can be constructed from one piece of material, such as injectable plastic, with several holes disposed therein. The holes can be used as the targets 205, and can be sized and positioned similar to the targets 205 described above. Moreover, other types of pipes can be used to construct the targets 205, such as metal pipe, aluminum pipe, composite pipe, or the like. In addition, plastic ratcheting rivets or zip ties can be used to attach the pipes together. Alternatively, in some embodiments, PVC glue or PVC cement can be used to attach the pipes together. PVC glue and/or cement can be desirable as it can cause the PVC of neighboring pipes to fuse or "melt" together, enabling a strong bond.

CONCLUSION

While several possible embodiments are disclosed above and throughout this specification, embodiments of the present invention are not so limited. For instance, while several possible tossing games, methods of playing such games, and game components have been provided, other suitable games, methods, components, or combinations could be selected without departing from the spirit of embodiments of the invention. In addition, the configuration used for various features of embodiments of the present invention can be varied according to the particular requirements of a particular game or scenario. Such changes are intended to be embraced within the scope of the invention.

The specific methods, method steps, systems, and other embodiments disclosed can be varied according to particular needs. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A station for use with a tossing game, the station comprising:

a plurality of targets arranged in a plurality of rows, each target having a point value associated with the target, the point value based on the row in which the target is arranged, and each target comprising:

a hollow vertical body comprising a front and a back;

a top rim having a top profile, the top rim defining an opening of the target and the top profile angled downward from horizontal from the back to the front; and a horizontal base disposed beneath the top rim;

wherein the hollow vertical body of each target substantially abuts at least one hollow vertical body of another target;

wherein one target of the plurality of targets is taller than each of the other targets and is located behind each of the other targets with respect to a horizontal plane;

wherein the top profiles of all of the targets, except the tallest target, share a common angular plane; and wherein the respective bases of the plurality of targets are aligned about a same elevation.

2. The station of claim 1, wherein the diameter of the targets in a first row of targets is smaller than the diameter of the targets in a second row of targets, the first row being located forward of the second row.

3. The station of claim 2, wherein the diameter of the targets in the second row of targets is smaller than the diameter of the targets in a third row of targets, the second row being located forward of the third row.

4. The station of claim 1, wherein at least one of the rows of targets is curved.

5. The station of claim 1, each target formed from a pipe and the targets fastened together with mechanical fasteners.

6. The station of claim 1, wherein the top profile of each target is angled approximately 20 degrees downward from horizontal from the back to the front of each target.

7. A tossing game comprising:

a first station and a second station each having a plurality of targets, each of the targets comprising (i) a hollow vertical body comprising a front and a back; (ii) a top rim having a top profile, the top rim defining an opening of the target and the top profile angled downward from horizontal from the back to the front; and (iii) a horizontal base disposed beneath the top rim;

wherein the hollow vertical body of each target substantially abuts at least one hollow vertical body of another target;

wherein one target of the plurality of targets is taller than each of the other targets and is located behind each of the other targets with respect to a horizontal plane;

wherein the top profiles of all of the targets, except the tallest target, share a common angular plane;

wherein the respective bases of the plurality of targets are aligned about a same elevation; and a plurality of tossing articles for tossing into the openings of the targets.

8. The tossing game of claim 7, wherein the targets are arranged in rows, each target having a point value associated with the target, the point value based on the row in which the target is arranged, and the award point value for each respective target being a function of the point value associated with the target.

9. The tossing game of claim 8, wherein the opening of each target in a first row of the first station has a first diameter, and wherein the opening of each target in a second row of the first station has a second diameter, the first diameter being smaller than the second diameter.

10. The tossing game of claim 7, wherein at least a first target of the plurality of targets comprises a first color representing a first point value and wherein at least a second target of the plurality of targets comprises a second color representing a second point value that is different than the first point value.

11. The tossing game of claim 7, wherein at least one tossing article of the plurality of tossing articles includes a cover portion comprising at least one of: duck cloth, canvas, nylon, burlap, wool, cotton, and polyester.

12. The tossing game of claim 7, wherein the top profile of each target is angled approximately 20 degrees downward from horizontal from the back to the front of each target.

* * * * *